US010859293B2

(12) United States Patent
Wu et al.

(10) Patent No.: US 10,859,293 B2
(45) Date of Patent: Dec. 8, 2020

(54) MECHANICAL VIBRATION-ISOLATED, LIQUID HELIUM CONSUMPTION-FREE AND EXTREMELY LOW TEMPERATURE REFRIGERATING SYSTEM

(71) Applicant: FUDAN UNIVERSITY, Shanghai (CN)

(72) Inventors: Shiwei Wu, Shanghai (CN); Shengyu Zhou, Shanghai (CN); Shuai Zhang, Shanghai (CN); Di Huang, Shanghai (CN); Lifeng Yin, Shanghai (CN); Chunlei Gao, Shanghai (CN); Jian Shen, Shanghai (CN)

(73) Assignee: FUDAN UNIVERSITY, Shanghai (CN)

( * ) Notice: Subject to any disclaimer, the term of this patent is extended or adjusted under 35 U.S.C. 154(b) by 144 days.

(21) Appl. No.: 16/068,521

(22) PCT Filed: Nov. 29, 2016

(86) PCT No.: PCT/CN2016/107662

§ 371 (c)(1),
(2) Date: Jul. 6, 2018

(87) PCT Pub. No.: WO2017/118241

PCT Pub. Date: Jul. 13, 2017

(65) Prior Publication Data

US 2019/0024949 A1 Jan. 24, 2019

(30) Foreign Application Priority Data

Jan. 6, 2016 (CN) ..... 2016 1 0002349

(51) Int. Cl.

| | |
|---|---|
| ***F25B 9/14*** | (2006.01) |
| ***F25B 9/00*** | (2006.01) |
| ***F25B 49/02*** | (2006.01) |

(52) U.S. Cl.

CPC ..... *F25B 9/14* (2013.01); *F25B 9/002* (2013.01); *F25B 9/145* (2013.01); *F25B 49/02* (2013.01);

(Continued)

(58) Field of Classification Search

CPC .. F25B 9/14; F25B 9/145; F25B 49/02; F25B 2309/001; F25B 2309/1428; F25B 2309/14

See application file for complete search history.

(56) References Cited

U.S. PATENT DOCUMENTS 5,163,297 A * 11/1992 Yani ..... F17C 13/006 250/352

7,414,250 B1 8/2008 Hersam et al.

(Continued)

FOREIGN PATENT DOCUMENTS

| | | |
|---|---|---|
| CN | 103234661 | 8/2013 |
| CN | 103901232 | 7/2014 |

(Continued)

OTHER PUBLICATIONS

PCT International Search Report for PCT/CN2016/107662 dated Feb. 22, 2017. (6 pages).

*Primary Examiner* — Ana M Vazquez

(74) *Attorney, Agent, or Firm* — Kilpatrick Townsend & Stockton LLP

(57) ABSTRACT

The present disclosure relates to the technical field of cryogenic cooling. In particular, the present disclosure relates to a mechanical vibration-isolated, liquid helium consumption-free cryogenic cooling device. The system according to some embodiments of the present disclosure comprises: a closed-cycle cryogenic cooling system, a helium heat exchange gas cooling and vibration isolation interface system, a cryogenic throttle valve cooling system, and a temperature feedback control system. The closed- (Continued)

cycle cooling system includes a cold head, a compressor, and a helium pipeline. The cryogenic throttle valve cooling system is thermally coupled to a low-temperature end of the cooling and vibration isolation interface.

23 Claims, 3 Drawing Sheets

(52) U.S. Cl.
CPC ..... *F25B 2309/001* (2013.01); *F25B 2309/14* (2013.01); *F25B 2309/1428* (2013.01)

(56) References Cited

U.S. PATENT DOCUMENTS

| | | | | |
|---|---|---|---|---|
| 2008/0209919 | A1* | 9/2008 | Ackermann | F25B 25/005 62/51.1 |
| 2014/0202174 | A1* | 7/2014 | Wang | F25B 9/14 62/6 |
| 2016/0178247 | A1* | 6/2016 | de Waele | F25B 9/14 62/6 |

FOREIGN PATENT DOCUMENTS

| | | |
|---|---|---|
| CN | 104236153 | 12/2014 |
| CN | 105571190 | 5/2016 |

* cited by examiner

MECHANICAL VIBRATION-ISOLATED, LIQUID HELIUM CONSUMPTION-FREE AND EXTREMELY LOW TEMPERATURE REFRIGERATING SYSTEM

CROSS-REFERENCE TO RELATED APPLICATIONS

This application is the national stage application under 35 U.S.C. 371 of PCT application number PCT/CN2016/107662 filed Nov. 29, 2016, which claims priority to Chinese application number CN 201610002349.8 filed Jan. 6, 2016, the disclosures of which are incorporated in their entirety by reference herein.

FIELD OF THE DISCLOSURE

The present disclosure relates to the technical field of cryogenic cooling. In particular, the present disclosure relates to a mechanical vibration-isolated, liquid helium consumption-free, cryogenic cooling device.

BACKGROUND

A cryogenic environment refers to an environment that is lower than the helium-4 gas-liquid phase change temperature of 4.2 K at a normal pressure. The cryogenic environment has applications in fields such as physics, chemistry, materials, biology, national defense, and information. The cryogenic environment is used in many high-end high-precision scientific researches and technical applications, which not only specify a cryogenic environment but also specify a low-vibration environment as well as a vacuum or even an ultra-high vacuum environment. Cooling systems that can achieve a cryogenic environment and a low vibration environment are currently available in the cryogenic equipment field, such as evaporative cooling systems and dilution refrigeration systems. However, the current evaporative cooling systems and dilution refrigeration systems require liquid helium consumption for operation, which is a scarce and expensive resource, driving operating costs relatively high. Furthermore, because of the limited capacity of liquid helium dewar, cryogenic environments generally cannot be maintained for a long period of time. In addition, large-scale variable temperature operations are difficult to achieve because the systems are limited by their cooling principles. Because of the increasing shortage of liquid helium supplies in recent years, some low temperature and ultralow temperature cryostats based on closed-cycle cooling systems, such as Gifford-McMahon and pulse tube cooling systems have emerged internationally. However, the operation of these closed-cycle cooling systems bring in low-frequency mechanical vibrations that cannot be ignored, limiting their applications that require both low vibration and cryogenic cooling. Thus, it is desirable to develop cryogenic devices that can achieve not only ultralow temperature without liquid helium consumption, but also low-vibration environment, which is compatible with vacuum or ultra-high vacuum.

SUMMARY

At least some embodiments of the present disclosure provide a mechanical vibration-isolated, liquid helium consumption-free, cryogenic cooling system whose operation does not consume liquid helium, can achieve ultralow temperatures, can continuously vary temperature in a large temperature range, can achieve a low-vibration environment, and is compatible with an ultra-high vacuum environment.

According to some embodiments, the mechanical vibration-isolated, liquid helium consumption-free, cryogenic cooling system provided by the present disclosure comprises: a closed-cycle cryogenic cooling system, a helium heat exchange gas cooling and vibration isolation interface system, a cryogenic throttle valve cooling system, and a temperature feedback control system. The closed-cycle cryogenic cooling system comprises: a cold head, a compressor, and a helium pipeline. The helium heat exchange gas cooling and vibration isolation interface system comprises: a cooling and vibration isolation interface, helium heat-exchange gas, and soft rubber components for sealing off the helium gas and isolating the vibration. The cryogenic throttle valve cooling system comprises: a heat switch, a throttle valve, a liquid helium vessel for helium-4 or helium-3, a vacuum pump, as well as inlet and outlet piping. The temperature feedback control system comprises a heating component, a temperature sensor, and a feedback temperature control component connected through a circuit.

In the helium heat exchange gas cooling and vibration isolation interface system, the cold head of the closed-cycle cooler extends into the cooling vibration isolation interface, and the helium heat exchange gas is filled between the cold head and the cooling vibration isolation interface as a cooling medium. The helium heat exchange gas acts as a heat-exchange medium for cooling and is also used to isolate the mechanical vibration of the cold head.

In the cryogenic throttle valve cooling system, the heat switch, the throttle valve, and the liquid helium vessel are connected sequentially. They are fixed to the low temperature end of the helium heat exchange gas cooling and vibration isolation interface system. In the cryogenic throttle valve cooling system, heat exchange between the high-pressure helium gas and the heat-exchange unit cool down the high-pressure helium gas. A vacuum pump is used to provide a low-pressure environment and further lowers the temperature through throttle cooling of the throttle valve to achieve ultralow temperature. The liquid helium vessel is used to store liquid helium formed through liquefaction of a portion of the helium gas in the cryogenic and low-pressure environment. This is the coldest end of the disclosed mechanical vibration-isolated, liquid helium consumption-free, cryogenic cooling system. The disclosed system can achieve temperatures as low as about 1.4 K for helium-4 medium; can achieve temperatures as low as about 0.2 K for helium-3 medium.

The temperature feedback control system can include two sections, which are respectively mounted adjacent to the helium vessel and low temperature end of the cooling vibration isolation interface. The heating component, the temperature sensor, and the feedback temperature control component are interconnected. The temperature feedback control component controls the temperature based on the feedback. A large-scale temperature variation can be achieved through the temperature control system.

In some embodiments, the types of closed-cycle cooling system include but are not limited to Gifford-McMahon cooling systems, Sterling cooling systems, pulse tube cooling systems, and improved cooling systems based on these systems. The cooling power and achievable low temperatures of the closed-cycle cooling systems may vary based on working principles and models.

In some embodiments, in order to make the disclosed mechanical vibration-isolated, liquid helium consumption-free, cryogenic cooling system compatible with the high-temperature baking conditions specified by customers' ultra-high vacuum environments, the cooling vibration isolation interface and the cryogenic throttle valve cooling system may use materials such as stainless steel (including but not limited to stainless steel 304, 316, 316L) and oxygen-free copper and welding technologies that are compatible with ultra-high vacuums.

The system of the present disclosure has at least some of the following advantages:

1. The closed-cycle cooler and cryogenic throttle valve cooling system of the present disclosure do not consume liquid helium. This solution resolves the technical problems of cryogenic equipment requiring the consumption of liquid helium, which is a scarce and costly resources.

2. The system of the present disclosure combines a closed-cycle cooler and cryogenic throttle valve cooling system which can achieve ultralow temperatures as low as 1.4 K (based on helium-4 medium) or 0.2 K (based on helium-3 medium). This solution resolves the technical problems that the closed cycle coolers is unable to achieve ultralow temperatures.

3. The helium heat exchange gas cooling and vibration isolation interface of the present disclosure effectively isolate the low-frequency mechanical vibrations from the closed-cycle cooler during operation. The present disclosure affords a cryogenic and low-vibration environment.

4. The temperature control system of the present disclosure can provide accurate feedback temperature control and can achieve a large-scale variable temperature operations.

5. The solution provided by the present disclosure to achieve ultralow temperature and low vibration under helium consumption-free conditions can also operate in ultra-high vacuum environments, and can sustain high temperature baking for achieving an ultra-high vacuum environment.

Figure 1:
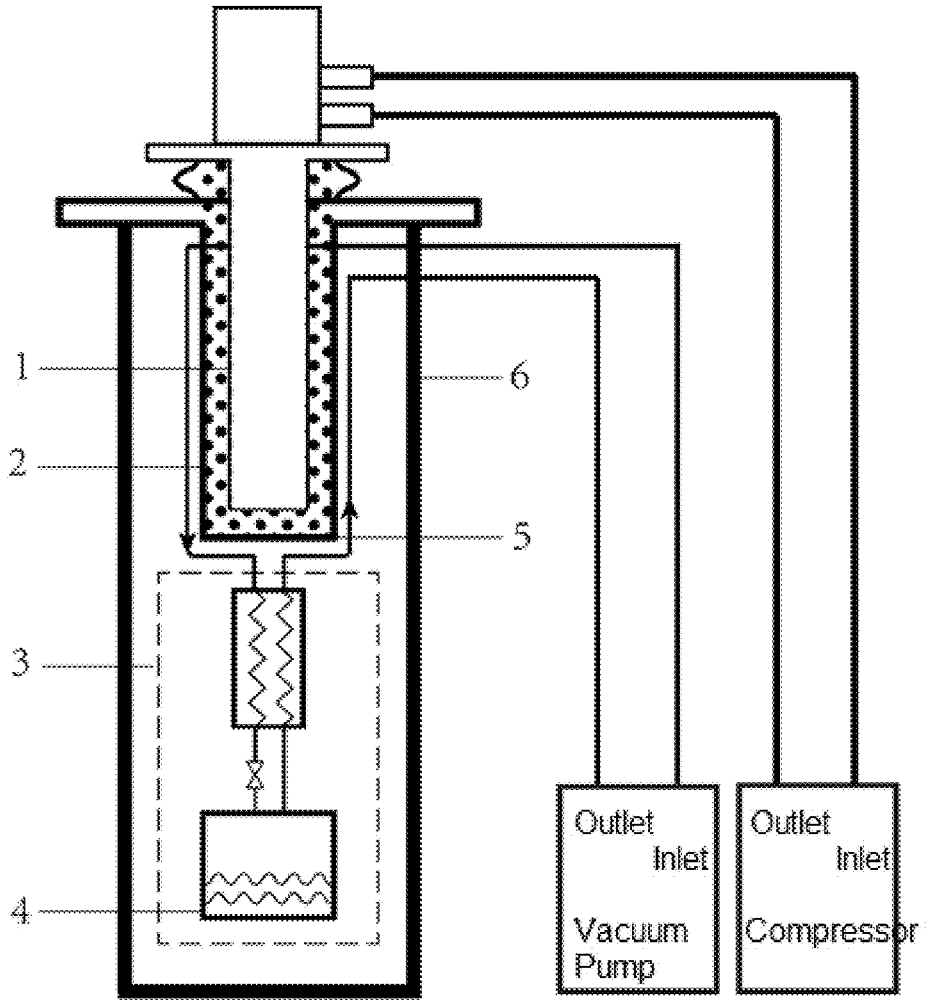
FIG. 1 is a schematic of a mechanical vibration-isolated, liquid helium consumption-free, cryogenic cooling device according to at least some embodiments of the present disclosure.
Figure 2:
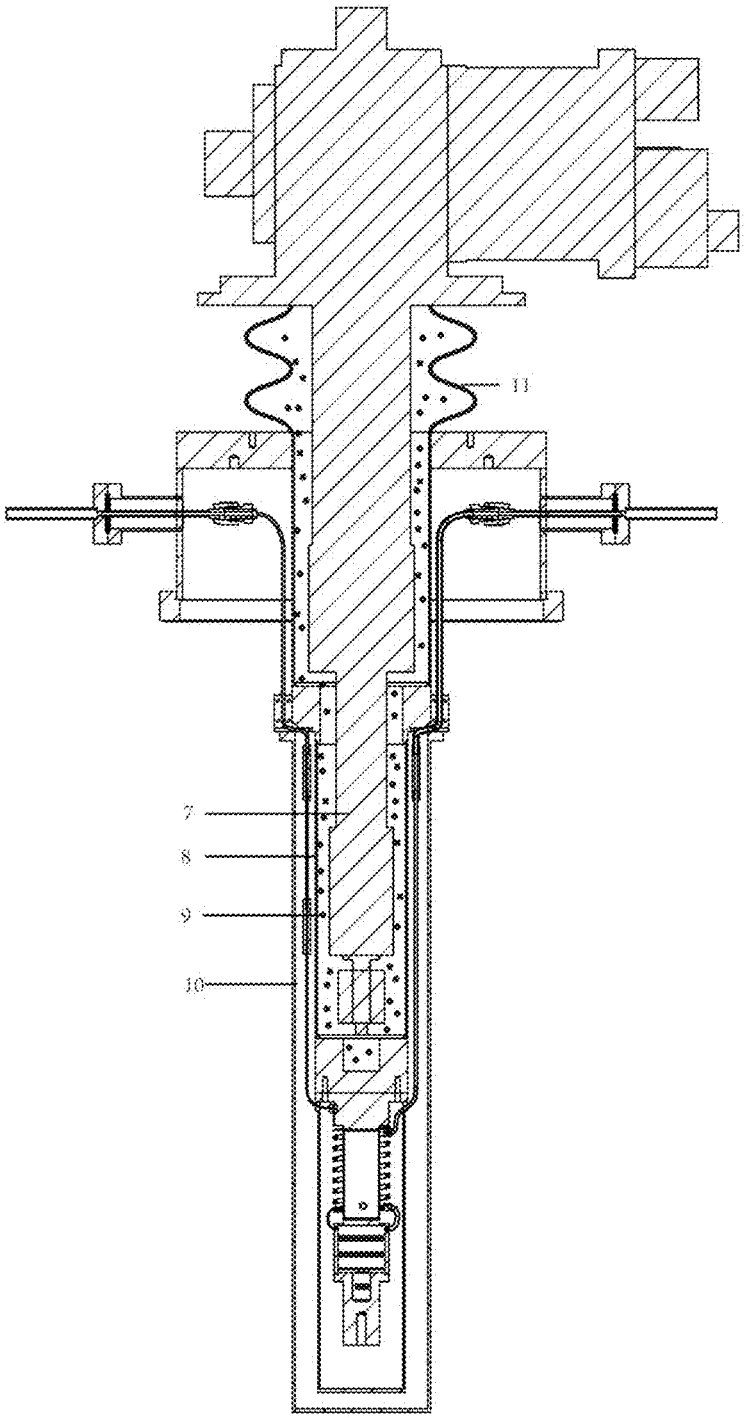
FIG. 2 is a sample assembly sectional diagram of a cold head component of a closed-cycle cryogenic cooling system, a helium heat exchange gas cooling and vibration isolation interface system, and a cryogenic throttle valve cooling system.
Figure 3:
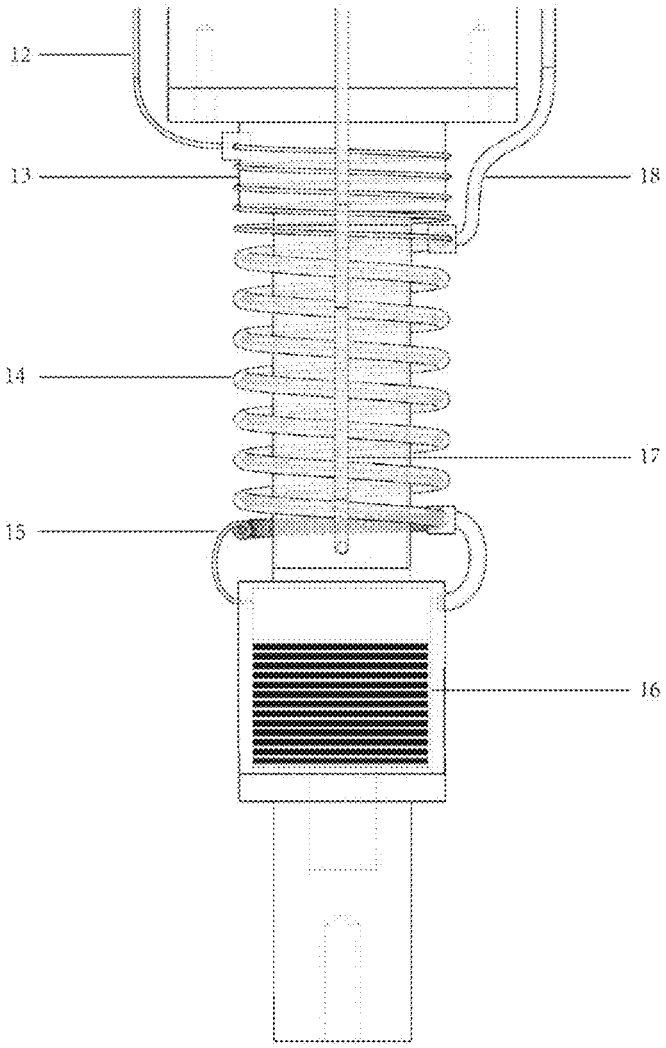
FIG. 3 is a sample assembly schematic of a cryogenic throttle valve cooling system.

Numerals within the figures: 1—Closed—cycle cooling system; 2—Helium heat exchange gas cooling and vibration isolation interface system; 3—Cryogenic throttle valve cooling system; 4—First temperature feedback control system; 5—Second temperature feedback control system; 6—Vacuum chamber; 7—Closed—cycle cold head; 8—Cooling and vibration isolation interface; 9—Helium heat exchange gas; 10—Thermal radiation shield; 11—Soft rubber; 12—Inlet gas piping; 13—Helium heat exchanger; 14—Counterflow heat exchange unit; 15—Throttle valve; 16—Liquid helium vessel (can include helium-4 or helium-3); 17—Thermal switch; 18—Outlet gas piping.

DETAILED DESCRIPTION

In order to further clarify the use of the present disclosure, embodiments have been presented below as well as reference diagrams for further detailed explanation of the present disclosure.

A device according to the present disclosure comprises: a closed-cycle cryogenic cooling system 1; a helium heat exchange gas cooling and vibration isolation interface system 2; a cryogenic throttle valve cooling system 3; and a temperature feedback control system, including a first temperature feedback control system 4 and a second feedback control system 5. Those components can be enclosed in a vacuum chamber 6.

The closed-cycle cryogenic cooling system 1 includes: a closed-cycle cold head 7, a compressor (shown in FIG. 1), and a helium gas pipeline. The helium heat exchange gas cooling and vibration isolation interface system 2 includes: a cooling and vibration isolation interface 8, a helium heat exchange gas 9, a thermal radiation shield 10, and soft rubber 11.

The cryogenic throttle valve cooling system 4 includes: inlet gas piping 12, a helium heat exchanger 13, a counterflow heat exchange unit 14, a throttle valve 15, a liquid helium vessel 16 (including, e.g., helium-4 or helium-3), a thermal switch 17, and outlet gas piping 18.

In the helium heat exchange gas cooling and vibration isolation interface system 2, the cold head 7 of the closed-cycle cooler extends into the cooling and vibration isolation interface 8, and the helium heat exchange gas 9 disposed between the cold head and the cooling vibration isolation interface acts as a cooling medium. The soft rubber 11 connects and seals the cold head 7 and the top end of the cooling and vibration isolation interface 8. While sealing the helium exchange gas 9, the soft rubber 11 can also isolate the low-frequency mechanical vibrations of the cold head. The thermal radiation shield 10 is fixed onto the cooling and vibration isolation interface 8 and is used to reduce the thermal leakage caused by the high-temperature radiation.

The temperature feedback control system includes a temperature sensor, a heating component, and a feedback temperature control component connected through a circuit. The first temperature feedback control system 4 and the second temperature feedback control system 5 are respectively mounted adjacent to the liquid helium vessel 16 and the low-temperature end of the cooling and vibration isolation interface 8.

In the cryogenic throttle valve cooling system 3, the helium heat exchanger 13, the thermal switch 17, and the liquid helium vessel 16 are sealed by, e.g., welding. The cryogenic throttle valve cooling system 3 is thermally coupled to the low-temperature end of the helium heat exchange gas cooling and vibration isolation interface system. The inlet gas piping 12 first performs a heat exchange with the helium heat exchanger 13 to lower the temperature; a portion of the inlet gas piping 12 then passes through the outlet gas piping 18 to form a counterflow heat exchange mechanism in order to further lower the temperature of the pre-throttle helium. The throttle valve 15 includes a metal line inserted into the inlet gas piping. The diameter of the metal line is close to the inner diameter of the inlet gas piping. The high-pressure helium gas achieves a cryogenic temperature after passing through the throttle valve, and a portion of the helium liquefies and forms liquid helium which is stored in the liquid helium vessel 16. The outlet gas piping connection is sealed and connected with the liquid helium vessel 16 though welding, and forms the counterflow thermal exchange mechanism along with the inlet gas piping. A vacuum pump (as shown in FIG. 1) can be used to provide a low-pressure environment for the helium vessel and the outlet gas piping, allowing the throttle cooling effect to sustain continuously.

When there is a certain amount of helium gas in the thermal switch 17, the thermal switch 17 is at "close" state; whereas the thermal switch is pumped into a vacuum environment, the switch is at "open" state. The thermal switch is used to control the heat conduction between the cryogenic throttle valve cooling system and the helium heat exchange gas cooling and vibration isolation interface system. When the thermal switch is closed, the thermal conductivity is increased, and the temperature can be rapidly lowered through the cooling effect of the cooling and vibration isolation interface. When the thermal switch is open, the heat transfer between the cooling and vibration isolation interface and the liquid helium vessel can be isolated to reduce thermal leakage.

In the inlet gas piping 12 and outlet gas piping 18, the pipe diameters may change depending on different temperatures and pressures to ensure that the mass flow rate of the helium gas in the piping remains a constant.

In some embodiments, a closed-cycle cooling system can be used to resolve the issue of cryogenic cooling operation specifying large quantities of liquid helium. Using a helium heat exchange gas cooling and vibration isolation interface resolves the issue of cooler operation producing micrometer-level and even larger amplitude of low-frequency mechanical vibrations. Using a cryogenic throttle valve cooling system resolves the issue of closed-cycle systems being unable to achieve ultralow temperatures. Using a temperature feedback control system can achieve large-range variable temperature operations. Materials such as oxygen-free copper and stainless steel 316L are used to make the cooling and vibration isolation interface and cryogenic throttle valve cooling system in a vacuum environment, and are compatible with the high-temperature baking conditions specified by an ultra-high vacuum environment.

The specific embodiments above further describe the purposes, technical solutions, and beneficial outcomes of the present disclosure. It should be understood that the above descriptions are only specific embodiments of the present disclosure and are not limitations of the present disclosure. Any modification, equivalent replacement or improvement performed within the spirit or principle of the present disclosure should be included within the scope of protection of the present disclosure.

What is claimed is:

1. A cryogenic cooling system, comprising:

a cooling and vibration isolation interface containing a helium heat exchange gas;

a closed-cycle cooling system including a cold head, a compressor, and a helium pipeline; and a cryogenic throttle valve cooling system thermally coupled to a low-temperature end of the cooling and vibration isolation interface, the cryogenic throttle valve cooling system including:

a helium heat exchanger thermally coupled with the low-temperature end, an inlet gas piping configured to allow a helium gas to flow from an external source into the cryogenic throttle valve cooling system to perform heat exchange between the helium gas and the helium heat exchange gas via the helium heat exchanger, the helium gas including helium-3 isotope, a throttle valve configured to liquefy the helium gas into a liquid helium, and a liquid helium vessel configured to store the liquid helium.

2. The cryogenic cooling system of claim 1, further comprising:

a feedback temperature control component disposed adjacent to the liquid helium vessel.

3. The cryogenic cooling system of claim 1, further comprising:

a feedback temperature control component disposed adjacent to the low-temperature end of the cooling and vibration isolation interface.

4. The cryogenic cooling system of claim 1, further comprising:

a thermal radiation shield fixed onto the cooling and vibration isolation interface to reduce radiation thermal leakage.

5. The cryogenic cooling system of claim 1, further comprising:

a rubber sealing the cold head and a top end of the cooling and vibration isolation interface and configured to isolate a mechanical vibration of the cold head.

6. The cryogenic cooling system of claim 1, wherein the helium heat exchange gas is configured to operate as a heat exchange medium and to isolate a mechanical vibration of the cold head.

7. The cryogenic cooling system of claim 1, wherein the cryogenic throttle valve cooling system further includes an outlet gas piping, a portion of the inlet gas piping is nested by a portion of the outlet gas piping, the portion of the inlet gas piping and the portion of the outlet gas piping are configured to perform a counterflow heat exchange between each other.

8. The cryogenic cooling system of claim 7, wherein the outlet gas piping is coupled to the liquid helium vessel.

9. The cryogenic cooling system of claim 1, wherein the throttle valve includes a metal line inserted into the inlet gas piping to achieve a cryogenic temperature for the helium gas passing through the throttle valve.

10. The cryogenic cooling system of claim 1, further comprising:

a thermal switch configured to control a heat conduction between the cryogenic throttle valve cooling system and the cooling and vibration isolation interface.

11. The cryogenic cooling system of claim 10, wherein in response to containing a pre-determined amount of helium gas, the thermal switch is configured to be closed for the heat conduction between the cryogenic throttle valve cooling system and the cooling and vibration isolation interface.

12. The cryogenic cooling system of claim 10, wherein in response to a vacuum, the thermal switch is configured to be open to cause a thermal isolation between the cryogenic throttle valve cooling system and the cooling and vibration isolation interface.

13. The cryogenic cooling system of claim 1, further comprising:

a vacuum pump configured to provide a low-pressure environment for the liquid helium vessel.

14. A method of cryogenic cooling, comprising:

operating an inlet gas piping of a cryogenic throttle valve cooling system to allow a helium gas including a helium-3 isotope to flow from an external source into the cryogenic throttle valve cooling system, the cryogenic throttle valve cooling system further comprising a throttle valve, and a helium heat exchange thermally coupled to a low-temperature end of a cooling and vibration isolation interface, the cooling and vibration isolation interface containing a helium heat exchange gas;

conducting a heat exchange between the helium gas and the helium heat exchange gas via the helium heat exchanger; and operating the throttle valve to liquefy a portion of the helium gas into a liquid helium.

15. The method of claim 14, wherein the helium heat exchange gas is configured to isolate a mechanical vibration of a cold head of a closed-cycle cooling system.

16. The method of claim 15, wherein a rubber is disposed to seal the cold head and a top end of the cooling and vibration isolation interface and configured to isolate a mechanical vibration of the cold head.

17. The method of claim 14, wherein a thermal radiation shield is fixed onto the cooling and vibration isolation interface to reduce radiation thermal leakage.

18. The method of claim 14, further comprising:

controlling, via a thermal switch, a heat conduction between the cryogenic throttle valve cooling system and the cooling and vibration isolation interface.

19. The method of claim 18, further comprising:

conducting a counterflow heat exchange between the helium gas transferring through a portion of the inlet gas piping and a portion of an outlet gas piping surrounding the portion of the inlet gas piping.

20. The method of claim 18, further comprising:

by controlling a quantity of the helium gas in the thermal switch, opening the thermal switch to cause a thermal isolation between the cryogenic throttle valve cooling system and the cooling and vibration isolation interface.

21. The method of claim 14, further comprising:

storing the liquid helium in a liquid helium vessel.

22. The method of claim 21, further comprising:

providing a low pressure to the liquid helium vessel by a vacuum pump connected through an outlet gas piping.

23. The method of claim 21, furthering comprising:

performing a cooling temperature adjustment based on sensing a first temperature of the liquid helium vessel and based on sensing a second temperature of a low-temperature end of the cooling and vibration isolation interface.

* * * * *